United States Patent [19]

Theodore et al.

[11] 4,201,655

[45] May 6, 1980

[54] PROCESS FOR MAKING METALLURGICAL COKE

[75] Inventors: Frank W. Theodore, Pittsburgh; George E. Wasson, Eighty-Four; William A. Jasulaitis, Wayne, all of Pa.; Everett Gorin, San Rafael, Calif.

[73] Assignee: Continental Oil Company, Stamford, Conn.

[21] Appl. No.: 970,845

[22] Filed: Dec. 18, 1978

Related U.S. Application Data

[63] Continuation-in-part of Ser. No. 857,155, Dec. 5, 1977, abandoned, which is a continuation-in-part of Ser. No. 751,621, Dec. 17, 1976, abandoned.

[51] Int. Cl.[2] ..... C10B 53/00; C10G 1/06

[52] U.S. Cl. ..... 208/8 LE; 201/22; 201/23; 208/45

[58] Field of Search ..... 201/6, 8, 21–24, 201/17, 28; 208/8 R, 8 LE, 45

[56] References Cited

U.S. PATENT DOCUMENTS

| | | | |
|---|---|---|---|
| 3,073,751 | 1/1963 | Gorin et al. | 201/24 X |
| 3,562,783 | 2/1971 | Gorin | 201/6 |
| 3,623,999 | 11/1971 | Juntgen et al. | 201/23 X |
| 3,892,654 | 7/1975 | Wright et al. | 208/8 LE |
| 3,997,422 | 12/1976 | Ball et al. | 208/8 LE |
| 4,030,982 | 6/1977 | Gorin et al. | 201/23 X |

*Primary Examiner*—Michael S. Marcus

*Attorney, Agent, or Firm*—William A. Mikesell, Jr.; F. Lindsey Scott

[57] ABSTRACT

An improved process for making metallurgical coke is provided as follows. An effluent slurry consisting essentially of coal extract, solvent and undissolved coal is obtained from the liquefaction of coal by solvent extraction. Solvent is removed from the slurry by distillation to produce a bottoms product which contains non-distillable extract, undissolved coal and residual solvent. The bottoms product is flowable at elevated temperatures below its carbonizing temperature and solidifiable at lower temperatures. The bottoms product is blended with sufficient finely divided hot coaly solids (unsuitable per se for making metallurgical coke) in a hot blending zone which is maintained at a temperature above the softening point of the non-distillable coal extract and below the coking temperature thereof to produce a solidifiable product which, in particulate solidified state, serves as part or all of the feedstock to a coking zone to produce coke suitable for use in a blast furnace.

5 Claims, 2 Drawing Figures

PROCESS FOR MAKING METALLURGICAL COKE

This application is a continuation-in-part of our earlier filed Application Ser. No. 857,155 of the same title filed Dec. 5, 1977, which is in turn a continuation-in-part of our earlier filed Application Ser. No. 751,621 of the same title, filed Dec. 17, 1976 each abandoned.

This invention relates to the production of coke from coal, and particularly to the production of feedstocks for conventional slot-type coke ovens.

In accordance with our invention, a process is provided which significantly extends the range of coals suitable for use in coke oven feedstocks for making metallurgical coke.

Our process, in its broadest aspects, comprises the following essential steps:

(1) subjecting said coal to solvent extraction in a coal liquefaction zone to yield an effluent slurry consisting essentially of coal extract, solvent, and undissolved coal;

(2) subjecting said effluent slurry to distillation in a solvent recovery zone to remove solvent and other distillates, and still leave a bottoms product which is flowable at elevated temperatures below its carbonizing temperature and solidifiable at lower temperatures;

(3) transferring said flowable bottoms product to a hot blending zone;

(4) blending said bottoms product while in a flowable state in said hot blending zone with sufficient finely divided coaly solids (i.e. coal, or solids derived from coal, for example, char) to form a blend which is solidifiable, said hot blending zone being maintained at a temperature above the softening point but below the carbonizing temperature of said bottoms product; and (5) feeding said blend in a particulate solidified state, and any coal or coals and any pitch that may be admixed therewith, to a coking zone which is maintained at a temperature sufficiently high to produce coke therefrom.

Figure 1:
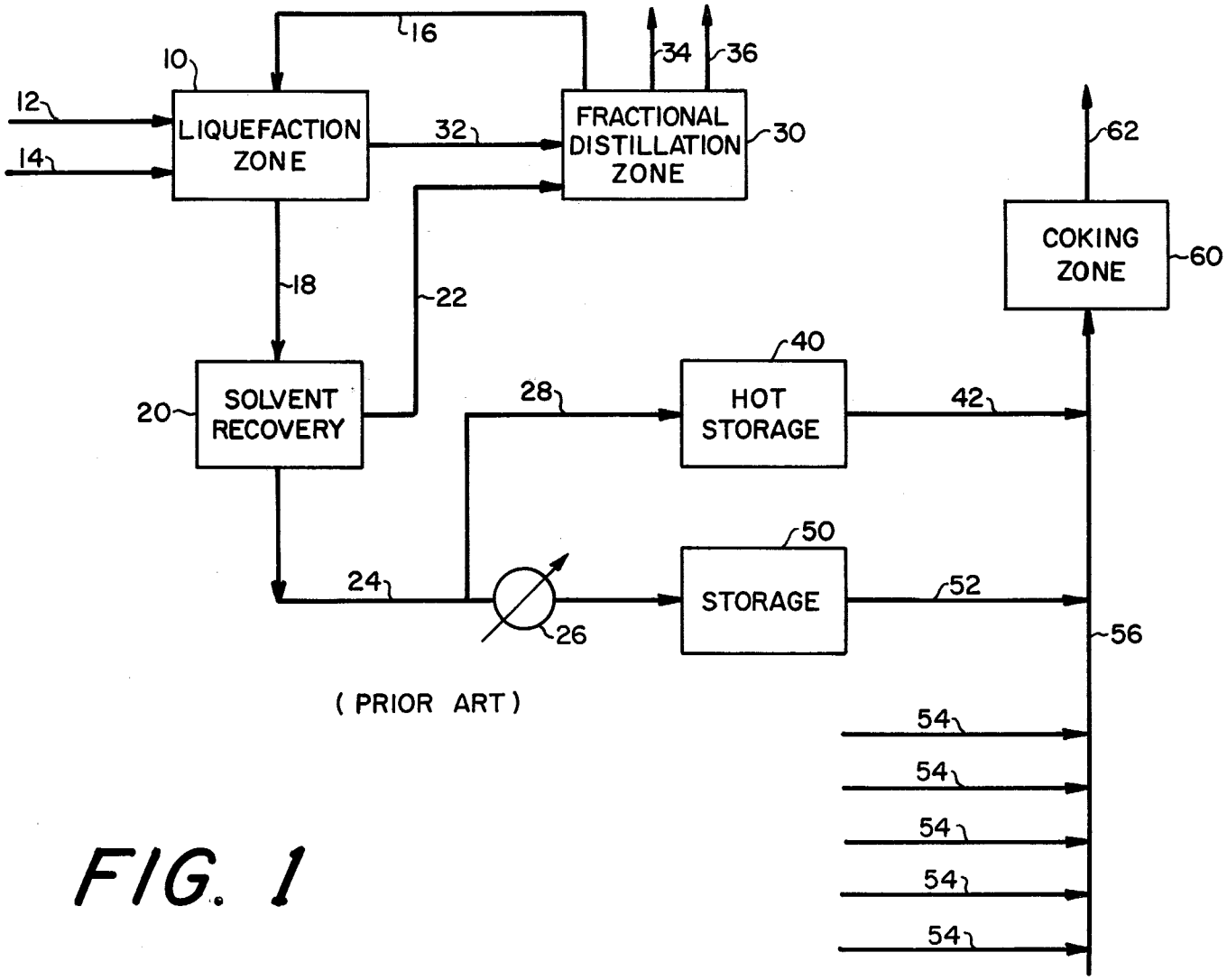
( PRIOR ART ) FIG. 1
Figure 2:
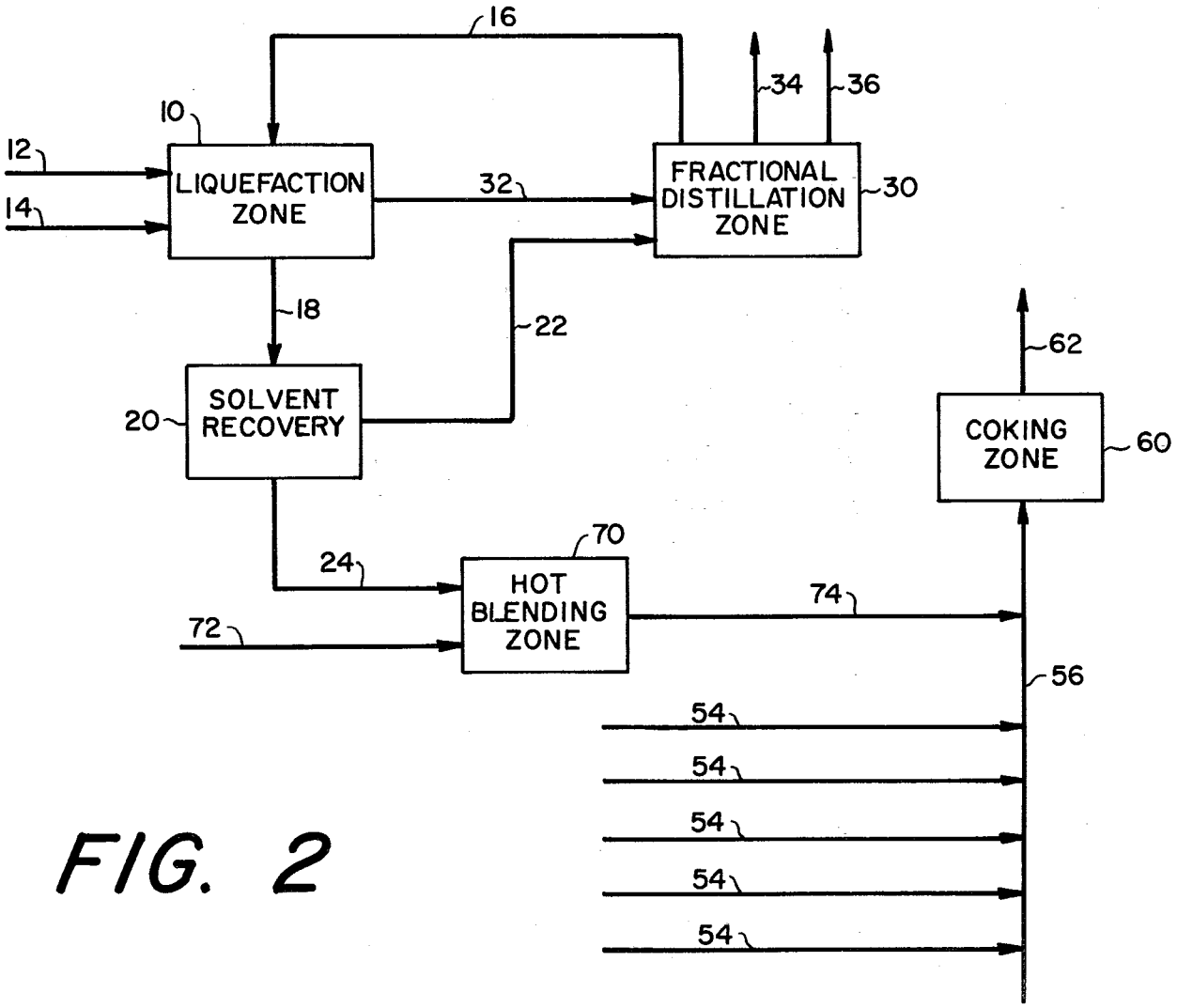

FIG. 1 is a schematic flowsheet of a prior art process for producing coke; and FIG. 2 is a schematic flowsheet of a coke producing process embodying the improvement of the present invention.

In the discussion of the Figures, the same numbers will be used throughout to refer to the same or similar components.

Referring to FIG. 1, a prior art process for producing coke from a blend of coaly solids is shown. Coal is charged to a liquefaction zone 10 via a line 12, with hydrogen also being optionally charged to liquefaction zone 10 via a line 14. A liquefaction solvent is charged to zone 10 via a line 16 with gases and effluent vapors being recovered from zone 10 via a line 32. An effluent stream comprising undissolved coal, solvent, and coal extract is recovered from zone 10 via a line 18 and passed to a solvent recovery zone 20 where at least a major portion of the solvent is recovered and passed via a line 22 to a fractional distillation zone 30 where gases are removed via a line 34 with distillates being removed through a line 36 with a recycle solvent being recovered and recycled to zone 10 via a line 16. A bottoms product comprising undissolved coal, residual solvent and coal extract is recovered from solvent recovery zone 20 via a line 24 and passed to storage after cooling in a heat exchanger 26. Storage 50 is a storage for solid particulate bottoms product. The solid bottoms product may be extrudates, flakes, crushed particles, agglomerates or the like. The form of solid particles is immaterial and the bottoms product may be solidified by means known to those skilled in the art. The solid product from storage 50 is passed via a line 52 in desired quantities to a conveyor 56 or the like which is used to convey a feedstock to a coking zone 60. A plurality of coaly, solid feedstreams are passed to conveyor 56 via a plurality of conveyors or lines 54. These coaly solids may comprise coals of varying grades, char, coke breeze, semi-coke or the like. The formulation of blends of coaly solids to produce feedstocks for coking zones is well known to those skilled in the art with the blends being used primarily to achieve desired properties of fluidity and volatility in the coking zone. Typically the feedstock to coking zone 60 has a volatile matter of about 26 to 34 wt % and a Gieseler Fluidity greater than about 200 dial divisions per minute (ASTM-D2639-74). Various other properties are also considered in the preparation of the blends of coaly solids to form the feedstock to the coking zone as is known to those skilled in the art. The bottoms product added to the stream conveyed to coking zone 60 via line 56 is added as desired to effect the blend properties. The bottoms product is a highly fluid, high volatile component which imparts desirable properties to the blend.

In a variation of the process shown in FIG. 1, the bottoms product is passed via a line 28 to a hot storage zone 40 and from storage 40 is passed in desired quantities via a line 42 to a spray or the like for spraying the fluid bottoms product on to the stream passed to coking zone 60 via conveyor 56. Processes such as shown in FIG. 1 are considered to be known to the art.

In FIG. 2, a similar process is shown with the primary difference being that the bottoms product recovered from zone 20 is passed to a hot blending zone 70 where it is intimately mixed with one or more of the coaly solids passed to coking zone 60. The blending may be by any method which produces solid or solidifiable agglomerates. The agglomerates may be cooled and then crushed or the like. Clearly extruding, pelletizing, agglomerating, or the like could be used to produce particulate material from the mixture produced in hot blending zone 70. Similarly, a storage vessel (not shown) could be positioned in line 74 if desired to even the flow to conveyor 56. The objective of hot blending zone 70 is to blend the bottoms product with a coaly solid under conditions such that the temperature in hot blending zone 70 is above the softening point of the bottoms product so that intimate mixing is accomplished but below the carbonizing temperature of the bottoms product. The mixture is then desirably solidified by any suitable means and mixed with the other feedstock components passing to coking zone 60 via line 56. It has been found that surprisingly desirable results are accomplished when the bottoms product is hot blended with at least one component of the feedstock passed to coking zone 60 to produce a solid for subsequent mixture with the blend of coaly solids charged to coking zone 60.

Any coal may be used as a feedstock to zone 10 including caking, weakly caking and non-caking bituminous coals as well as sub-bituminous coals including lignite. Solvent extraction appears to improve the caking, i.e. coking, properties of the raw coal provided the conversion of the coal by the solvent is carried sufficiently far, generally, with the addition of hydrogen, either by way of a hydrogen donor solvent or gaseous hydrogen or both. The precise depth of conversion required for such improvement in caking properties may be readily determined by routine experimentation. In the presently preferred embodiment, the use of a weakly caking coal is preferred since it otherwise has only limited value, if any, in the preparation of feedstock for making metallurgical coke. A typical weakly caking coal has the following pertinent specifications: wt. % volatile matter (dry basis)=41.4; wt. % ash=8.7; wt. % S=3.00; FSI (Free Swelling Index) (ASTM-D720-67)=2½; and Gieseler Fluidity (DDPM-Dial Division Per Minute) (ASTM-D2639-74)=1.1.

In the practice of the present invention, the coal, after suitable drying and crushing, is conducted to liquefaction zone 10. While the same coal may be used as a feed to liquefaction zone 10 and as a component of the feedstock fed to the coking zone 60, the coal fed to coking zone 60 may be different from that fed to liquefaction zone 10.

In liquefaction zone 10, a liquefaction solvent is used to convert the coal principally to an effluent slurry. A suitable liquefaction solvent is a mixture of polycyclic aromatic hydrocarbons which is liquid under the conditions of temperature and pressure maintained during coal liquefaction. A suitable boiling range for such a solvent is from about 230° to about 475° C. The solvent may be conveniently derived as a distillate fraction from one or more of the unit operations of the present process. If so, such a solvent may contain phenols and heterocyclic compounds as well as the polycyclic hydrocarbons.

The selected coal, in a finely divided state, is subjected, in liquefaction zone 10, to solvent extraction in the presence of hydrogen available at the extraction conditions. The extraction operation may be any of those used by those skilled in the art, for example, continuous, batch, countercurrent or staged extraction. Hydrogen for the hydrotreatment is optionally supplied as gaseous hydrogen as shown in the drawing; however, it may be supplied by means of a hydrogen-donor solvent, alone or in conjunction with gaseous hydrogen. If gaseous hydrogen is used, the solvent may be any suitable polycyclic aromatic hydrocarbon, or mixtures of polycyclic aromatic hydrocarbons which are liquid at the temperature and pressure of extraction, and derived from the process itself as previously mentioned. If a hydrogen-donor solvent is used, at least a portion of the polycyclic aromatic hydrocarbons is partially hydrogenated. Such a solvent is suitably re-hydrogenated to maintain its effectiveness as a hydrogen donor.

The conditions maintained in the liquefaction zone 10 are typically as follows:

| | |
|---|---|
| Temperature, °C. | 375–475 |
| Pressure, Kg/cm$^2$ | 30–200 |
| H addition, wt. % MAF* coal | 0.70–2.5 |
| Solvent-to-coal (wt. ratio) | 1.5–30 |

*MAF is moisture-and-ash free coal.

The product consists of a minor amount of effluent gases and vapors which are sent to fractional distillation zone 30 via line 32 and a major amount of effluent slurry which is sent in its entirety to solvent recovery zone 20 via line 18. The effluent slurry consists essentially of solvent, extract and residue, i.e. undissolved hydrocarbonaceous solids and ash. Solvent recovery zone 20 is optionally a vacuum tower wherein as much as possible of the solvent is recovered by distillation without coking while still leaving behind a flowable bottoms product. Desirably the bottoms product is flowable at temperatures from about 175° C. up to its carbonizing temperature and is a solid at temperatures below about 40° C. The solvent and other distillates are conducted via conduit 22 to fractional distillation zone 30. Gases, distillates and solvent are suitably recovered from zone 30 via lines 34, 36 and 16 respectively with the solvent being recycled via conduit 16 to liquefaction zone 10. Solvent may be suitably added or removed as needed. The bottoms product from solvent recovery 20 contains nondistillable extract and residue along with undistilled solvent, generally at least 5 percent by weight, to ensure that the bottoms product is flowable, and hence pumpable. The bottoms product is pumped to a hot blending zone 70 via conduit 24. Any coaly solid could be used as a coaly solid feedstream to zone 70 via line 72. In the broadest aspect of the present invention, the bottoms product could be blended with the entire feedstock to coking zone 60. While such an embodiment is possible, it has been found desirable to blend the bottoms product material with one or more of the least fluid of the components added to the mixture forming the feedstock to coking zone 60. Low temperature carbonization char, anthracite, coke breeze and the like are suitable low fluidity coaly solids. Low temperature carbonization char is a preferred coaly solid for blending with the bottoms product. The bottoms product is highly fluid and has a relatively high volatile matter and it is desirable that it be reasonably widely and uniformly distributed through the feedstock to coking zone 60. It has been found that such is accomplished by hot blending the bottoms product with one or more of the coaly solids to form a solid blend which is then mixed with the remaining solids comprising the feedstock to coking zone 60. As indicated the bottoms product could be mixed with the blend of coals flowing to zone 60 but it has been found that surprisingly desirable results are accomplished when the bottoms product is blended with one or more of the less fluid components of the blend charged to coking zone 60.

While Applicants do not wish to be bound by any particular theory, it appears that the addition of the bottoms product as set forth herein results in positioning the bottoms product in a relatively nonflowable condition (i.e. as a part of the particulate solids formed in zone 70) in the feedstock to coking zone 60 so that its fluidity is available locally in the feed blend in coking zone 60 during coking in contrast to other modes of addition which do not restrict the flowability of the bottoms product during coking. When the flowability of the bottoms product is not restricted prior to carbonization, the bottoms product is free to flow through the feedstock or the like.

Hot blending zone 70 may be any suitable hot mixer, for example, a rotary drum arranged to rotate about its slightly inclined horizontal axis. The temperature within the drum is preferable maintained adiabatically, that is by the heat of the incoming coaly solids and bottoms product. The temperature in zone 70 is maintained above the softening point of the mixture of bottoms product and coaly solids, and preferably above the melting point of the extract, but below the coking temperature of the mixture, so that the bottoms product is in a liquid state. A suitable temperature is from about 200° to about 350° C. The solids typically constitute about two-thirds of the contents. The relative proportions of liquids and solids are regulated or adjusted by means known to the art to maintain the desired ratio. The object is to discharge a blended product from hot blending zone 70 which is solid or solidifiable to a solid by cooling. The blended product is preferably formed into pellets in blending zone 70 by the tumbling action caused by the rotation of the drum, but such is not necessary since the solidified product may be extruded, recovered, cooled and then crushed to the desired size or the like. The pellets, if formed, are generally mushy and hence difficult to handle until cooled to a solidified state. The solid pellets may be used as is, or crushed if not of the desired size.

The blended product, in particulate solid state, may be fed as the sole feedstock to coking zone 60 to yield metallurgical coke of satisfactory hardness and strength; however, it is preferred to mix the particulate solids from the blending zone 70, with other coals which, by themselves in a blended state, may or may not serve as a satisfactory feedstock. Thus, conservation of such other coals becomes possible through the adoption of our process. It is pointed out that the foregoing description of preferred embodiments is illustrative rather than limiting in nature and that many variations and modifications are possible within the scope of the present invention. Many such variations and modifications may be considered obvious and desirable to those skilled in the art based on the foregoing description of preferred embodiments and the following examples.

Experimental work has demonstrated that excellent quality blast furnace coke can be produced in accordance with the abovedescribed preferred embodiment.

EXAMPLE 1

Tests were run using low temperature char and a bottoms product to demonstrate the difference in coke quality of cokes produced by hot blending as set forth herein and by blending at room temperature. In the tests, low temperature char and bottoms product were blended in a rotary kiln in a weight ratio of 38 wt. % bottoms product and 62 wt. % char. The only difference in the two tests was that in test one the bottoms product and char were blended at room temperature (21° C.), and in test two, the bottoms product and char were blended at about 300° C. In test one, the bottoms product was cooled to a solid prior to blending. In both tests the blend so produced was fed to an 18-inch moveable wall coke test oven which simulates conventional slot-type coke ovens. The 18-inch test oven was that normally used for testing coke quality and the properties reported were measured by standard methods used in the steel industry. Except for the blending temperatures, the tests were at the same conditions and used the same feedstocks, i.e. char and bottoms product. The blend of the bottoms product and char was charged to the test oven as the total feedstock to the test oven. The test conditions and coke properties are set forth below in Table 1.

Table 1

Summary Table of Comparative Results of Moveable Wall Oven Test

| Run No. | 1 (Cold) | 2 (Hot) |
|---|---|---|
| Blending Temperature, °C. | about 21 (70° F.) | about 300 (570° F.) |
| Coke Quality | | |

Table 1-continued

Summary Table of Comparative Results of Moveable Wall Oven Test

| Run No. | 1 (Cold) | 2 (Hot) |
|---|---|---|
| ASTM Coke Stability, +1" | 60.4 | 66.4 |
| ASTM Coke Hardness, +¼" | 64.8 | 69.1 |
| Coke Shatter, +2" | 79.0 | 76.0 |
| Coke Shatter, −½" | 1.0 | 1.5 |
| Average Size, inches | 2.85 | 3.15 |
| Cumulative Size, Wt. % | | |
| +4" | 23.7 | 28.9 |
| +3" | 47.7 | 48.5 |
| +2" | 75.2 | 75.7 |
| +1½" | 85.3 | 89.3 |
| +1" | 89.6 | 93.6 |
| +½" | 94.3 | 96.5 |
| Coke Yield, Wt. % | 79.4 | 76.0 |
| Coking Conditions | | |
| Flue Temperature, °F. | 2300 | 2300 |
| Coke Time, Hrs. | 19 | 19 |

It is clear from the test results in Table 1 that the coke produced by hot blending has improved hardness and stability, both of which are desirable properties in metallurgical coke.

EXAMPLE 2

Further tests were run to demonstrate the difference in coke quality in cokes produced by hot blending a bottoms product with a coal feedstock subsequently added to a blend of coal feedstocks charged to a coke oven, and coke similarly produced by cold (room temperature) blending. The bottoms product was produced from Arkwright coal having the following specifications: wt. % S=2.6; FSI (Free Swelling Index—ASTM-D720-67)=7; and Gieseler Fluidity (DDPM-Dial Division Per Minute—ASTM-D2639-74)=28,500. The bottoms product was blended with Emery coal in all tests to form a mixture which was subsequently mixed with a blend of coal feedstocks to produce a charge to the 18-inch coke test oven. Emery coal has the following specifications: wt. % volatile matter (dry basis)=41.49; wt. % ash=9.11; wt % S=1.08; FSI=1; and Geiseler Fluidity=1.6. The bottoms product and Emery coal were blended in a weight ratio of 40 wt. % bottoms product and 60 wt. % Emery coal. The cold blending was done in a "V" cone blender with the resulting mixture being blended with the other components of the coke oven feed as shown in Table 2 below. The hot blending was accomplished by charging the bottoms product and the Emery coal in the proportions shown to a rotary kiln operated at the temperatures shown to produce a mixture of bottoms product and Emergy coal which was solidified, crushed and blended with the other components of the coke oven feed as shown in Table 2 below.

Table 2

| | Test No. 1 | 2 | 3 |
|---|---|---|---|
| Feed Composition, Wt. % | | | |
| Lynco Coal | 14.0 | 14.0 | 14.0 |
| Jenkins Jones Coal | 11.0 | 11.0 | 11.0 |
| Illinois #6 Coal | 25.0 | 25.0 | 25.0 |
| Itmann Coal | 20.0 | 20.0 | 20.0 |
| Anthracite coal | 3.0 | 3.0 | 3.0 |
| Petroleum coke | 2.0 | 2.0 | 2.0 |
| Powellton Coal | 10.0 | 10.0 | 10.0 |
| Emery Coal | 9.0 | 9.0 | 9.0 |
| Arkwright Coal bottoms product | 6.0 | 6.0 | 6.0 |
| Run Conditions - Coke Oven | | | |

Table 2-continued

| | Test No. | | |
|---|---|---|---|
| | 1 | 2 | 3 |
| Feedstock pulverization wt. % ⅛" | 80.5 | 82.6 | 81.6 |
| Moisture as charged wt. % | 5.8 | 5.6 | 5.4 |
| Bulk density in oven lb/ft$^3$ | 53.3 | 52.5 | 52.9 |
| Dry bulk density lb/ft$^3$ | 50.2 | 49.6 | 50.1 |
| Flue temperature °F. | 2300 | 2300 | 2300 |
| Coking time net, hours:minutes | 16:55 | 17:44 | 18:08 |
| Coke center temp when pushed °F. | 1800 | 1800 | 1800 |
| Probe pressure psig | 0.25 | 0.25 | 0.00 |
| Blend Temperature | | | |
| °F. | 70 | 400 | 570 |
| °C. | 21 | 205 | 300 |
| Coke Quality | | | |
| ASTM Coke Stability +1" | 52.9 | 54.7 | 54.9 |
| ASTM Coke Hardness +¼" | 63.1 | 64.5 | 63.9 |
| Coke Shatter +2" | 81.0 | 80.6 | 79.6 |
| Coke Shatter −½" | 2.0 | 1.7 | 1.7 |
| Average size, inches | 2.75 | 2.78 | 2.80 |
| Apparent Specific Gravity | 0.70 | 0.89 | 0.92 |
| Coke Yield, Wt. % | 73.9 | 73.8 | 73.8 |

It is clear that even when the bottoms product is present at levels as low at 6 wt. % in the blend of coals fed to the coke oven, the use of hot blending results in the production of coke of improved stability and hardness in contrast to that obtained by cold blending.

According to the provisions of the patent statutes, the principle, preferred construction and mode of operation of the invention have been explained and what is considered to represent its best embodiment has been illustrated and described. However, it should be understood that, within the scope of the appended claims, the invention may be practiced otherwise than as specifically illustrated and described.

We claim:

1. In a process for producing coke from coal, said process consisting essentially of:

(a) subjecting said coal to solvent extraction in a coal liquefaction zone to yield an effluent slurry consisting essentially of coal extract, solvent and undissolved coal;

(b) subjecting said effluent slurry to distillation in a solvent recovery zone to remove said solvent and produce a bottoms product consisting essentially of non-distillable coal extract, undissolved coal and residual solvent, said bottoms product being flowable at temperatures between 175° C. and below its carbonizing temperature and solidifiable at lower temperatures; and (c) adding said bottoms product to coaly solids said coaly solids being selected from the group consisting of coals, char, semi-coke and coke to produce a blend of said coaly solids with said bottoms product for use as a feedstock to a slot-type coke oven coking zone to produce coke suitable for use in a blast furnace, the improvement comprising: mixing said bottoms product with at least one of said coaly solids at an elevated temperature above the softening temperature of said bottoms product and below the carbonization temperature of said bottoms product, said elevated temperature being between about 200° to about 350° C., and cooling the resulting blend to produce a particulate blend of said bottoms product and said coaly solids for use as a feedstock to a coke oven thereby producing coke of an improved quality upon coking said blend.

2. The improvement of claim 1 wherein said bottoms product is mixed with at least one coaly solid at an elevated temperature below the carbonization temperature of said bottoms product to produce a mixture of said bottoms product and said coaly solid and thereafter adding said mixture to other coaly solids to form said blend for use as a feedstock to a blast furnace.

3. The improvement of claim 1 wherein said bottoms product is a solid at temperatures below 40° C.

4. The improvement of claim 1 wherein said bottoms product is mixed with char at a temperature from about 200° to about 350° C. to produce a mixture for use as a feedstock to a coke oven.

5. The improvement of claim 4 wherein said mixture is blended with at least one other coaly solid to produce said blend.

* * * * *